US006375436B1

(12) United States Patent
Irie et al.

(10) Patent No.: US 6,375,436 B1
(45) Date of Patent: Apr. 23, 2002

(54) HYBRID COMPRESSOR HAVING TWO DRIVE SOURCES

(75) Inventors: Kazuhiro Irie; Yukio Sakurai; Yasutaka Negishi; Masahiko Tamegai, all of Konan (JP)

(73) Assignee: Zexel Corporation, Tokyo (JP)

( * ) Notice: Subject to any disclaimer, the term of this patent is extended or adjusted under 35 U.S.C. 154(b) by 0 days.

(21) Appl. No.: 09/581,027

(22) PCT Filed: Oct. 26, 1999

(86) PCT No.: PCT/JP99/05909

§ 371 Date: Jun. 8, 2000

§ 102(e) Date: Jun. 8, 2000

(87) PCT Pub. No.: WO00/26538

PCT Pub. Date: May 11, 2000

(30) Foreign Application Priority Data

Oct. 29, 1998 (JP) ..... 10-308652

(51) Int. Cl.[7] ..... F04B 49/00; F04B 17/03

(52) U.S. Cl. ..... 417/223; 417/362; 417/374

(58) Field of Search ..... 417/316, 362, 417/374, 223, 16; 62/236, 228.4, 133, 323.4

(56) References Cited

U.S. PATENT DOCUMENTS

| | | | | |
|---|---|---|---|---|
| 5,867,996 A | * | 2/1999 | Takano et al. | 62/175 |
| 5,934,360 A | * | 8/1999 | Ban et al. | 165/43 |
| 6,092,993 A | * | 7/2000 | Young et al. | 417/53 |
| 6,247,899 B1 | | 6/2001 | Ban et al. | 417/16 |

FOREIGN PATENT DOCUMENTS

| | | |
|---|---|---|
| JP | 6-87678 | 12/1994 |

* cited by examiner

*Primary Examiner*—Charles G. Freay
(74) *Attorney, Agent, or Firm*—Wenderoth, Lind & Ponack, L.L.P.

(57) ABSTRACT

A hybrid compressor achieving simplification in the structure and capable of driving the compression unit with ease is provided. An electromagnetic clutch unit (40) is provided at a rotating shaft (11) projecting out on one side of a compression unit (10) and an electric motor unit (70) is provided at the rotating shaft (11) projecting out on the other side of the compression unit (10), so that an electromagnetic clutch unit (40) in the prior art can be utilized directly. At the same time, since the electric motor unit (70) is provided at the rotating shaft (11) projecting out the other side of the compression unit (10), the electromagnetic clutch unit and the electric motor unit are set at the same rotating shaft (11) and the compression unit (10) and the electric motor unit (70) are positioned next to each other to reduce the torsional torque generated at the rotating shaft (11).

11 Claims, 5 Drawing Sheets

HYBRID COMPRESSOR HAVING TWO DRIVE SOURCES

TECHNICAL FIELD

The present invention relates to a hybrid compressor having two drive means, that is employed in an air-conditioning system mounted in a hybrid vehicle which is driven by two drive means, i.e., an internal combustion engine and an electric motor.

BACKGROUND ART

The hybrid compressor disclosed in Japanese Unexamined Utility Model Publication No.H-87678 is provided with two drive sources, i.e., an engine and a battery-driven motor unit to drive the rotating shaft at the compression unit so that the rotating shaft at the compression unit is driven by either of the two drive sources that are selectively connected to the rotating shaft. In the hybrid compressor, the motor shaft of the motor is linked to the rotating shaft at the compression unit, and an electromagnetic clutch is provided between a pulley to which the motive power of the engine is communicated and a pulley to which the motive power of the rotating shaft is communicated, and either the rotating shaft or the motor shaft, so that the rotation of one of the pulleys is selectively communicated to the rotating shaft. The electromagnetic clutch is electrically connected in such a manner that by turning on the electromagnetic clutch, the motive power from the engine causes the rotor at the motor unit to rotate to charge the batteries and that, by turning off the electromagnetic clutch, the motor unit is caused to rotate on power supplied by the batteries.

However, the hybrid compressor described above having the electromagnetic clutch and the motor provided on one side of the rotating shaft at the compression unit necessitates a rotor constituting the motor and the armature of the electromagnetic clutch to be mounted as an integrated part of the rotating shaft with the stator of the electric motor jointly mounted at the supporting/retaining portion of the electromagnetic clutch, resulting in a highly complicated structure. In addition, as illustrated in FIG. 2 of the publication quoted above, when providing the motor on the outside of the electromagnetic clutch, the distance between the compression unit and the rotor of the motor increases, and this poses a problem in that the torsional torque occurring at the rotating shaft and the motor shaft causes damage to the retaining area over which the rotating shaft and the motor shaft are secured to each other. Furthermore, it is not desirable for a compressor mounted within the engine room to assume a structure having the motor unit projecting out beyond the electromagnetic clutch.

Accordingly, an object of the present invention is to provide a hybrid compressor that achieves simplification in its structure and a higher degree of ease for driving the compression unit.

SUMMARY OF THE INVENTION

In the hybrid compressor according to the present invention comprising a compression unit having a rotating shaft and a compression space, the volumetric capacity of which is varied through the rotation of the rotating shaft, a pulley mounted at the rotating shaft of the compression unit, to which the rotation of an internal combustion engine is communicated, an electromagnetic clutch that selectively connects the pulley to the rotating shaft to communicate the rotation of the internal combustion engine to the rotating shaft and an electric motor unit constituted of a rotor secured to the rotating shaft and a stator facing opposite the rotor. The rotating shaft passes through the compression unit, the electromagnetic clutch is provided at the rotating shaft projecting out on one side of the compression unit and the electric motor unit is provided at the rotating shaft projecting out on the other side of the compression unit in this hybrid compressor.

Thus, since the electromagnetic clutch is provided at the rotating shaft projecting out on one side of the compression unit and the electric motor unit is provided at the rotating shaft projecting out on the other side of the compression unit, an electromagnetic clutch in the prior art can be directly utilized. In addition, since the electric motor unit is provided at the rotating shaft projecting out on the other side of the compression unit, the electric motor and the electromagnetic clutch are provided at the same rotating shaft and the compression unit and the electric motor unit can be set adjacent to each other to achieve the object described above.

In addition, it is desirable that the hybrid compressor assume a structure of a rotary compressor in which the compression unit is constituted of a rotor secured to the rotating shaft and a compression space, the volumetric capacity of which is varied through the rotation of the rotor. The hybrid compressor should preferably be provided with a capacity-varying mechanism that varies the discharge quantity by varying the position at which the intake port opens during an intake process in which the compression space expands in response to the rotation of the rotor.

Alternatively, the hybrid compressor may assume a structure of a piston-type compressor in which the compression unit is provided with a plurality of cylinders formed along the direction of the axis of the rotating shaft and pistons caused to engage in reciprocal movement inside the cylinders by the rotation of the rotating shaft. In this case, the hybrid compressor should preferably be provided with a capacity-varying mechanism that varies the discharge volume by varying the angle of a rotating inclined plate that causes the piston to move reciprocally within the cylinder as the rotating shaft rotates to limit the distance over which the piston travels.

Since the rotary compressor and the piston-type compressor both assume a structure that accommodates the rotating shaft to pass through the compression unit and the presence of the capacity-varying mechanism enables control for reducing the startup torque, problems that would otherwise occur at the startup of the electric motor can be prevented.

DETAILED DESCRIPTION OF THE INVENTION

The following is an explanation of the embodiments of the present invention, given in reference to the drawings.

Figure 1:
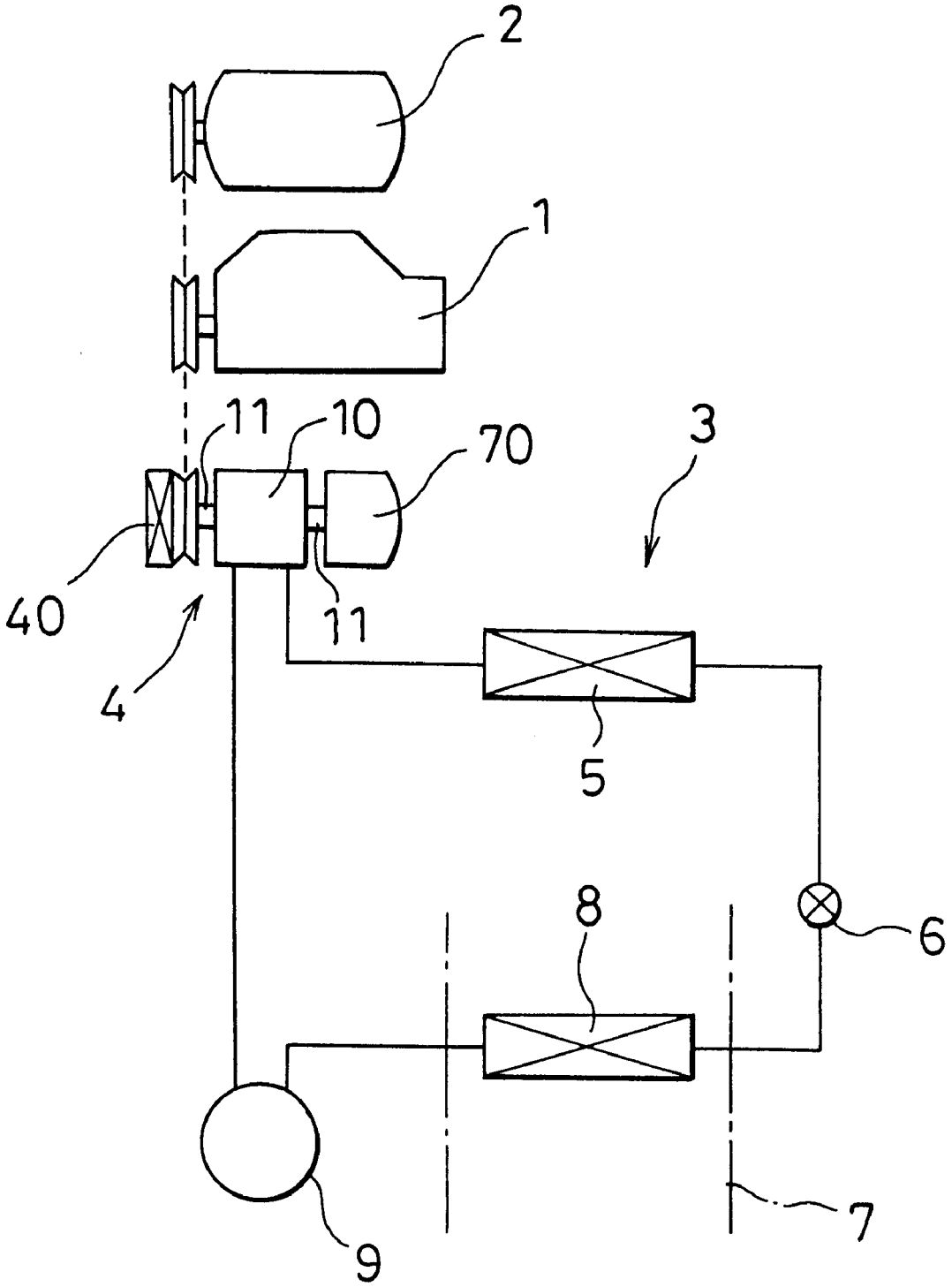
FIG. 1 is a schematic block diagram illustrating an example of a freezing cycle which may be provided in the hybrid vehicle air conditioning system according to the present invention.

FIG. 1 illustrates an example of a freezing cycle in an air-conditioning system installed in a hybrid vehicle having two drive sources, i.e., an internal combustion engine 1 such as a gasoline engine, a diesel engine or the like and a batter-driven electric motor 2 for vehicle drive. This freezing cycle 3 comprises, at least, a hybrid compressor 4 to be detailed below and a condenser 5 that cools and condenses a coolant compressed by the hybrid compressor 4, an expansion valve 6 that adiabatically expands the coolant in a liquid-phase state after being condensed by the condenser 5 to set it in a gas-liquid mixed state, an evaporator 8 provided inside a duct 7 of the air-conditioning system, that absorbs the heat of the air passing through the duct 7 to evaporate the coolant set in the gas-liquid mixed state by the expansion valve 6 and an accumulator 9 that achieves gas-liquid separation for the coolant evaporated by the evaporator 8.

The hybrid compressor 4 is provided with a compression unit 10, a rotating shaft 11 passing through the compression unit 10, an electromagnetic clutch unit 40 provided at the rotating shaft 11 projecting on one side of the compression unit 10 and an electric motor unit 70 provided at the rotating shaft 11 projecting out on the other side of the compression unit 10.

Figure 2:
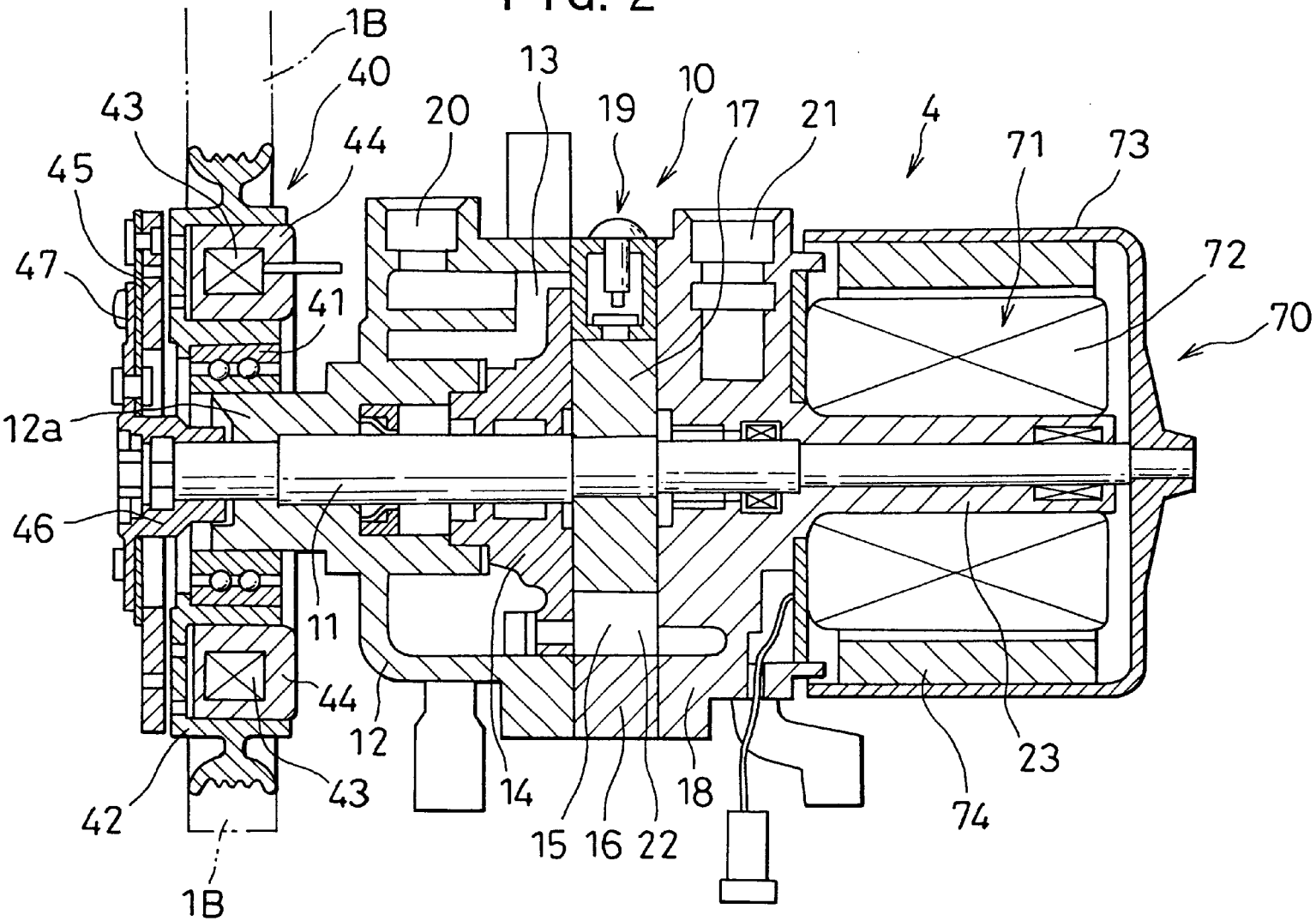
FIG. 2 is a sectional view of a first embodiment of the hybrid compressor.

The hybrid compressor 4 may assume the structure illustrated in FIG. 2, for instance. In the hybrid compressor 4 in the first embodiment, the compression unit 10 is constituted of a front head 12 at which the electromagnetic clutch unit 40 is mounted and secured, a front side block 14 provided inside a low pressure space 13 formed inside the front head 12 to block one side of a compression space 15 (to be detailed later) along the axial direction, a cylinder block 16 that defines the compression space 15, a rotor 17 provided in the compression space 15 inside the cylinder block 16 to vary the volumetric capacity of the compression space 15 and a rear head 18 that blocks the other side of the compression space 15 along the axial direction. In addition, an intake port 20 communicating with the low pressure space 13 is formed at the front head 12, and a discharge port 21 communicating with a discharge valve mechanism 19 formed at the cylinder block 16 is formed at the rear head 18.

Thus, as the rotating shaft 11 rotates, the rotor 17 is caused to rotate inside the compression space 15 and a vane 22 provided at the rotor 17 travels along the internal circumferential surface of the cylinder block 16 to expand or contract the compression space 15. This causes the coolant to be taken in through the intake port 20 when the compression space 15 is expanded, and compresses the coolant when the compression space 15 is contracted to discharge the high-pressure coolant through the discharge port 21 via the discharge valve mechanism 19.

The electromagnetic clutch unit 40 provided at one end of the rotating shaft 11 is secured to a front end 12*a* of the front head 12 at the compression unit 10 via a bearing 41. At the external circumference of the bearing 41, a pulley 42 to be connected to a pulley of the internal combustion engine 1 via a belt 1B is provided. The pulley 42, which is provided with an electromagnetic attraction portion 44 that is excited by a coil 43, rotates at all times while the internal combustion engine 1 is in operation.

An armature 45 is provided facing opposite the electromagnetic attraction portion 44. The armature 45 is linked to a hub 46 secured to the rotating shaft 11 via an elastic member 47 constituted of a plate spring or the like in such a manner that it can move freely along the axial direction, and is drawn to the electromagnetic attraction portion 44 which is excited when power is supplied to the coil 43 to link the pulley 42 and the hub 46 so that the rotation of the internal combustion engine 1 is communicated to the rotating shaft 11.

The electric motor unit 70, which is located on the side opposite from the electromagnetic clutch unit 40 across the compression unit 10, is constituted of a stator 71 formed at the rear head 18 of the compression unit 10 and secured to a motor mounting projection 23 through which the rotating shaft 11 passes and a rotor 73 secured to the end of the rotating shaft 11 passing through and extending out of the motor mounting projection 23. In this embodiment, the electric motor unit 70 is a brushless motor. A coil 72 that generates a rotating magnetic field is wound around the stator 71 and the rotor 73 is provided with a permanent magnet 74 at a position facing opposite the stator 71. As a result, when power is supplied to the coil 72, a rotating magnetic field is generated at the stator 71, which causes an attraction/repulsion force to manifest at the permanent magnet 74 to cause the rotor 73 to rotate.

Thus, since the compression unit 10 is driven by the motive force of the internal combustion engine 1 by turning on the electromagnetic clutch unit 40 when the hybrid vehicle is driven by the internal combustion engine 1 and the compression unit 10 is rotated by the electric motor unit 70 by turning off the electromagnetic clutch unit 40 and supplying power to the electric motor unit 70 when the internal combustion engine 1 in the hybrid vehicle is stopped and the hybrid vehicle is driven by the electric motor 2 for vehicle drive, it is possible to prevent any excess load from being applied to the electric motor 2 for vehicle drive and to operate the compression unit 10 in a stable manner.

The following is an explanation of the other embodiments of the present invention, with the same reference numbers assigned to components having identical structural features or achieving identical functions to those in the first embodiment to preclude the necessity for repeated explanation thereof.

Figure 3:
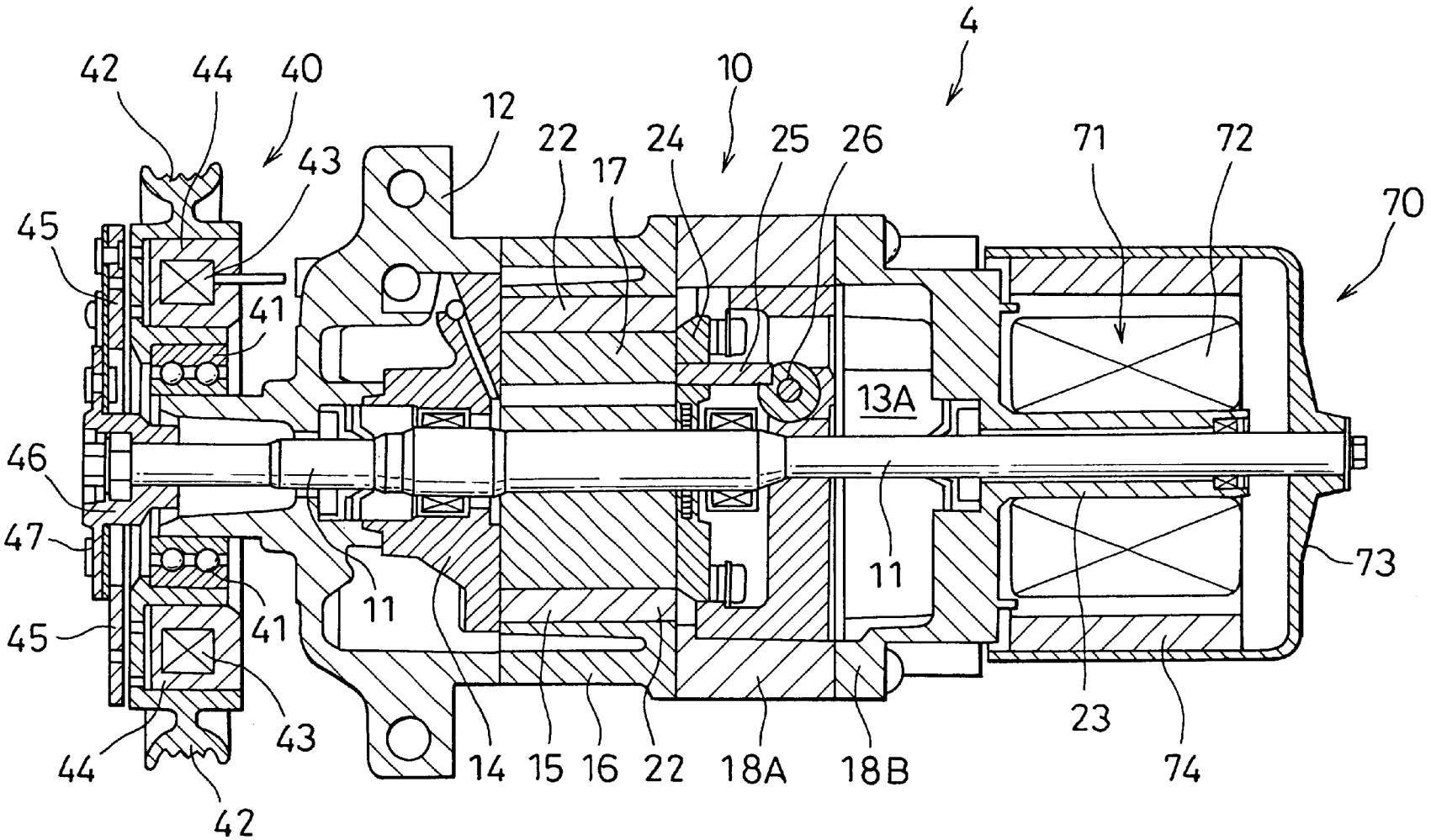
FIG. 3 is a sectional view of a second embodiment of the hybrid compressor.

A hybrid compressor 4 illustrated in FIG. 3, which is a rotary compressor having a compression unit 10 structured similarly to that in the first embodiment, is provided with a capacity-varying mechanism.

This capacity-varying mechanism is constituted of a rotating plate 24 provided within an intake space 13A formed inside rear blocks 18A and 18B closing off the other side of the cylinder block 16 along the axial direction, which displaces the position of the intake port (not shown) communicating between the compression space 15 and the intake space 13A relative to the position of the compression space 15, a rod 25 provided to cause the rotating plate 24 to rotate and a displacement mechanism 26 that displaces the front end of the rod 25. When reducing the discharge quantity, the position at which the communication of the compression space 15 and the intake space 13A starts during the intake process is retarded, whereas the position at which the communication starts is advanced to increase the discharge quantity.

By providing the capacity-varying mechanism described above, the discharge capacity can be reduced during the initial period of drive effected by the electric motor unit 70 to reduce the drive torque imparted to the electric motor unit 70, thereby achieving smooth drive.

Figure 4:
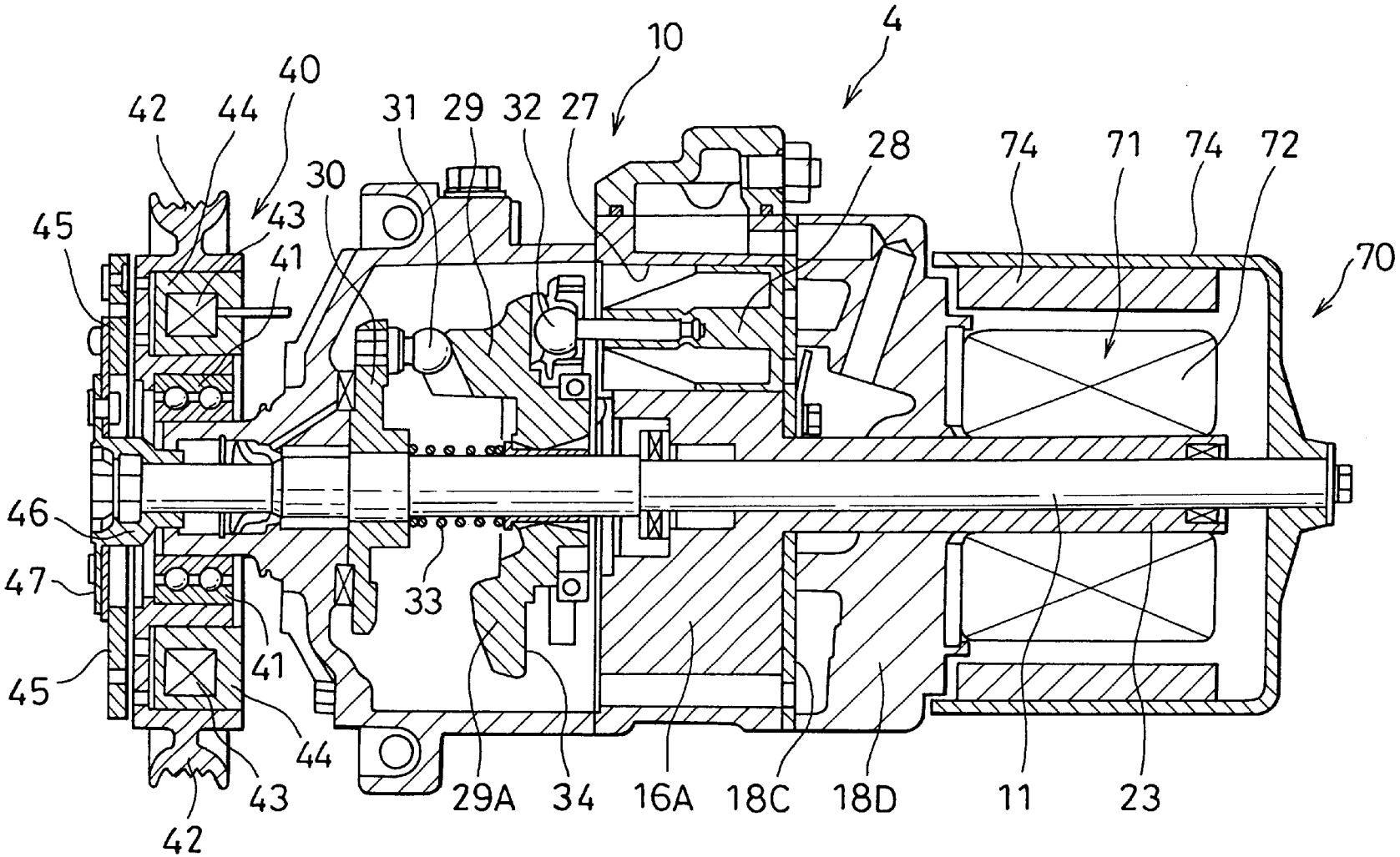
FIG. 4 is a sectional view of a third embodiment of the hybrid compressor.

In the embodiment illustrated in FIG. 4, the compression unit 10 assumes a structure of a piston-type compressor instead of that of the rotary compressor described above. The compression unit 10 constituted as a piston-type compressor comprises a plurality of cylindrical compression spaces 27 formed along the direction of the axis of a cylinder block 16A, a piston 28 that engages in sliding reciprocal movement inside each compression space 27, a rotating inclined plate 29 that cause the pistons 28 to engage in reciprocal movement in the compression spaces 27 and a rotating plate 30 that causes the rotating inclined plate 29 to rotate while the rotating shaft 11 rotates.

In addition, a ball portion 31 which interlocks with the rotating inclined plate 29 is provided at a specific position near the external circumference of the rotating plate 30 that rotates as the rotating shaft 11 rotates, and the rotating inclined plate 29 is caused to rotate in response to rotation of the rotating shaft 11 via the ball portion 31. The rotating inclined plate 29 is provided with a contact sliding surface 34 which comes in contact with a moving shaft 32 to which the pistons 28 are linked, and the moving shaft 32 placed in contact with the contact sliding surface 34 engages in reciprocal movement along the axial direction when the rotating inclined plate 29 rotates at an angle.

At the front surface of the compression space 27, a plate 18C having an intake port and a discharge port formed therein is clamped and secured between a rear head 18D and the cylinder block 16A. Furthermore, the cylinder block 16A is provided with a motor mounting projection 23 passing through and extending out of the rear head 18D to secure the stator 71 of the electric motor unit 70.

In the hybrid compressor 4 structured as described above, the capacity of the compression unit 10 is varied by moving a vertex 29A of the rotating inclined plate 29 with the ball portion 31 set as the fulcrum to change the inclining angle of the rotating inclined plate 29 and ultimately to change the distance over which the piston 28 travels. It is to be noted that FIG. 4 shows the rotating inclined plate 29 set at the position at which the discharge capacity is at the smallest.

Figure 5:
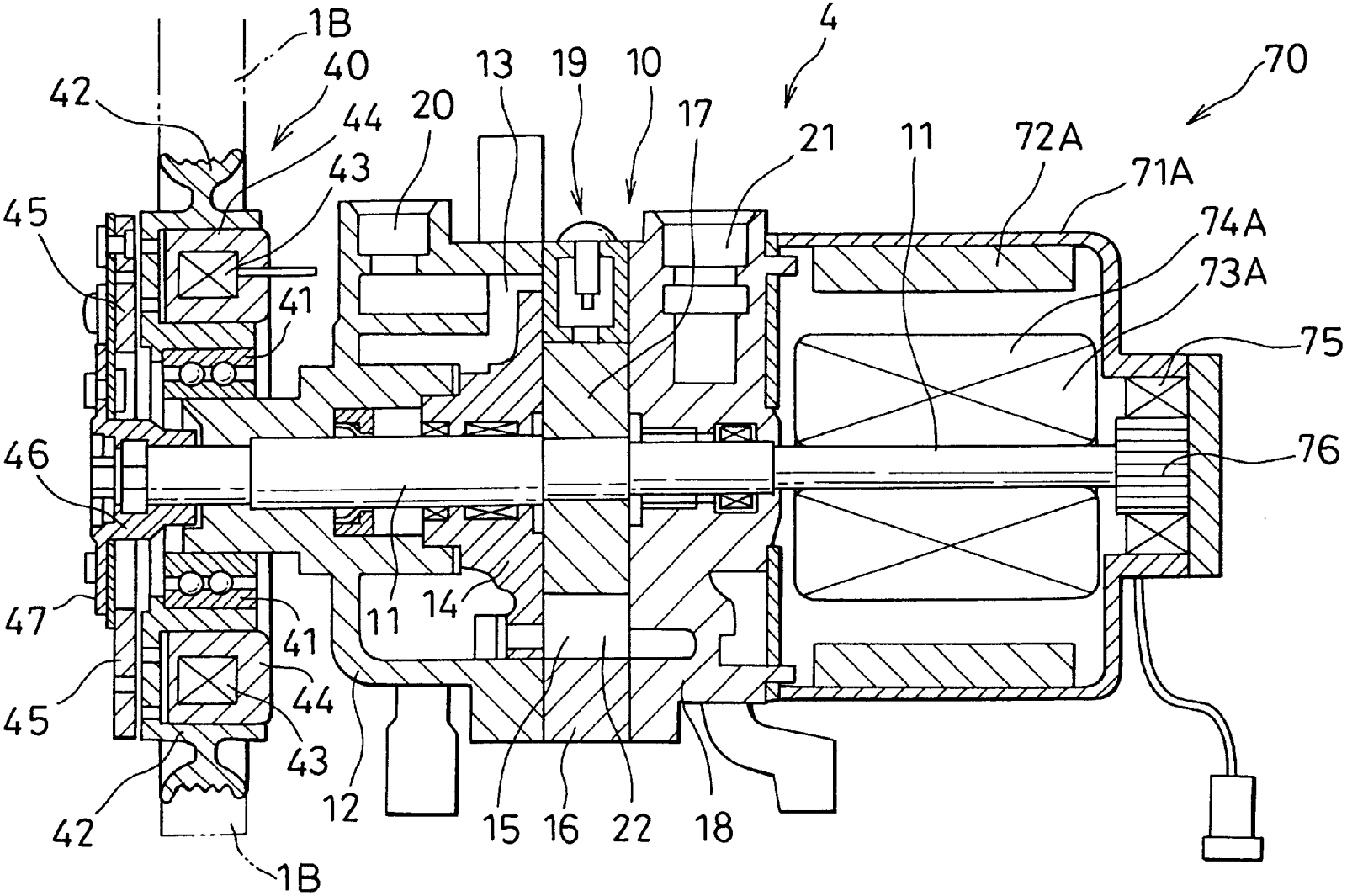
FIG. 5 is a sectional view of a fourth embodiment of the hybrid compressor.

The electric motor unit 70 of the hybrid compressor 4 shown in FIG. 5 is constituted of an electric motor having a brush 75 and a commutator 76. The electric motor unit 70 is constituted by winding a coil 74A for generating a magnetic field around a rotor 73A secured to the rotating shaft 11 and providing a stator 71A secured to the rear head 18 in an outward direction relative to the rotor 73A, with a permanent magnet 72A provided at the stator 71A at a position facing opposite the rotor 73A.

In addition, an electric motor unit 70, which invariably engages in rotation when the electromagnetic clutch unit 40 is turned on, may be utilized to rectify the electromotive force generated at the coils 72 and 74A in order to charge the battery for driving the electric motor 2 for vehicle drive and the electric motor unit 70.

INDUSTRIAL APPLICABILITY

As explained above, in the hybrid compressor according to the present invention having an electromagnetic clutch unit for linking with the internal combustion engine for vehicle drive on one side of the compression unit and a battery-driven electric motor unit on the other side of the compression unit, an electromagnetic clutch in the prior art can be directly utilized to achieve a reduction in the number of required parts so that an improvement in the assemblability is achieved and that any increase in the production cost can be minimized. In addition, since the electric motor unit can be provided in the vicinity of the compression unit, any problems caused by torsional torque imparted to the rotating shaft can be eliminated.

Furthermore, since the electric motor unit is not incorporated into the electromagnetic clutch unit but assumes an independent structure instead, the electric motor unit is placed in direct contact with external air to improve the cooling performance and the motor efficiency. Moreover, since the discharge volume can be adjusted in conformance to the operating state of the electric motor unit by providing the capacity-varying mechanism, the motive power saving performance of the electric motor unit is improved.

We claim:

1. A hybrid compressor comprising:

a compression unit having a rotating shaft, a compression space and a compression mechanism for varying a volumetric capacity of the compression space by rotation of said rotating shaft;

an electromagnetic clutch unit, located at one side of said compression unit and connected at a first end portion of said rotating shaft, for selectively drivingly connecting said first end portion of said rotating shaft to an internal combustion engine and drivingly disconnecting said first end portion of said rotating shaft from the internal combustion engine; and an electric motor located at another side of said compression unit, said electric motor comprising a rotor secured at a second end portion of said rotating shaft opposite said first end portion of said rotating shaft, and a stator facing opposite said rotor for generating a rotating magnetic field to rotate said rotor.

2. A hybrid compressor according to claim 1, wherein:

said electromagnetic clutch unit comprises at least one armature secured at said first end portion of said rotating shaft, and an electromagnetic attraction portion to be drivingly connected to the internal combustion engine.

3. A hybrid compressor according to claim 1, further comprising:

a pulley secured to said first end portion of said rotating shaft for use in transmitting drive of the internal combustion engine to said rotating shaft, said electromagnetic clutch being operably disposed between said rotating shaft and said pulley to selectively drivingly connect said pulley to said rotating shaft and drivingly disconnect said pulley from said rotating shaft.

4. A hybrid compressor according to claim 2, wherein:

said first and second end portions of said rotating shaft project from said compression unit in opposite directions.

5. A hybrid compressor according to claim 1, wherein:

said first and second end portions of said rotating shaft project from said compression unit in opposite directions.

6. A hybrid compressor according to claim 1, wherein:

said compression unit comprises a rotary compressor including a rotor secured to said rotating shaft and said compression space whose volumetric capacity is varied with rotation of said rotor.

7. A hybrid compressor according to claim 6, wherein:

said compression unit is provided with a capacity-varying mechanism that makes discharge quantity vary by changing position of intake port openings in an intake process in which said compression space expands in response to the rotation of said rotor.

8. A hybrid compressor according to claim 1, wherein:

said compression unit comprises a piston-type compressor having at least a plurality of cylinders formed along an axial direction of said rotation shaft and pistons reciprocally disposed in said cylinders for reciprocation upon rotation of said rotating shaft.

9. A hybrid compressor according to claim 8, wherein:

said compression unit is provided with a capacity-varying mechanism having a rotating inclined plate which makes said pistons reciprocate in said cylinders respectively upon rotation of said rotating shaft, whereby discharge volume of said compressor unit is varied by varying an angle of said rotating inclined plate to limit movement of said pistons.

10. A hybrid compressor according to claim 1, wherein:

said compression unit is provided with a cylinder block in which said compression space is formed, a front head located at one side of said cylinder block and a rear head located at another side of said cylinder block;

said electromagnetic clutch is provided on said front head; and said electric motor is provided on said rear head.

11. A hybrid compressor according to claim 10, wherein:

a motor mounting projection is formed on said rear head, and said rotating shaft passes through said motor mounting projection to project outwardly therefrom;

said stator of said electric motor is secured on said motor mounting projection; and said rotor of said electric motor is secured on said rotating shaft extending from said motor mounting projection so as to cover said stator.

* * * * *